US006856777B2

(12) United States Patent
Enomoto et al.

(10) Patent No.: US 6,856,777 B2
(45) Date of Patent: Feb. 15, 2005

(54) IMAGE FORMING APPARATUS WITH FIRST AND SECOND CHARGING MEMBERS FOR CHARGING RESIDUAL TONER

(75) Inventors: Naoki Enomoto, Shizuoka (JP); Takashi Shibuya, Shizuoka (JP); Masaru Shimura, Shizuoka (JP); Seiji Saito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/244,012

(22) Filed: Sep. 16, 2002

(65) Prior Publication Data

US 2003/0053820 A1 Mar. 20, 2003

(30) Foreign Application Priority Data

Sep. 18, 2001 (JP) ..... 2001-283116

(51) Int. Cl.[7] ..... G03G 21/00
(52) U.S. Cl. ..... 399/128; 399/129
(58) Field of Search ..... 399/128, 129, 399/168, 170, 171, 172, 173, 174, 175, 176, 71, 101

(56) References Cited

U.S. PATENT DOCUMENTS 5,751,405 A * 5/1998 Aita et al. ..... 399/175
5,809,373 A * 9/1998 Yoda et al. ..... 399/101
5,842,081 A * 11/1998 Kaname et al. ..... 399/174
5,881,343 A * 3/1999 Momotani et al. ..... 399/174
5,991,566 A * 11/1999 Tanaka et al. ..... 399/101
6,400,919 B1 * 6/2002 Inoue et al. ..... 399/176

FOREIGN PATENT DOCUMENTS

JP 01245283 A * 9/1989 ..... G03G/21/00
JP 9-44007 2/1997
JP 11-161043 6/1999
JP 2001-154548 6/2001

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

The present invention provides an image forming apparatus comprising an image bearing member for bearing a toner image, a movable intermediate transferring member, a first charging member for charging toner on the intermediate transferring member when it is applied with a voltage including an AC component, and a second charging member for charging toner on the intermediate transferring member when it is applied with a DC voltage, the second charging member being located on an upstream side of the first charging member with respect to a moving direction of the intermediate transferring member, wherein a toner image on the image bearing member is temporarily transferred to the intermediate transferring member and then transferred to a transfer material.

14 Claims, 5 Drawing Sheets

IMAGE FORMING APPARATUS WITH FIRST AND SECOND CHARGING MEMBERS FOR CHARGING RESIDUAL TONER

BACKGROUND OF THE INVENTION

1. Field of the Invention

The present invention relates to an image forming apparatus utilizing an electrophotography method such as a copying machine or printer and, particularly relates to an image forming apparatus that cleans up residual toner on an intermediate transferring member, etc.

2. Related Background Art

Conventionally, various methods, such as electrophotography methods, thermal transfer methods and ink jet methods are well known for use in a color image forming apparatus. Among these, electrophotography methods have advantages over other methods in terms of the image forming rate, image quality and acoustical property.

Many methods exist for an image forming apparatus utilizing electrophotography. These include, for example, the multi-development method in which an image formed of a color developer (multicolored toner image) is put onto a surface of a photosensitive member and then it is transferred at a time onto a transfer material as a recording material, the multi-transfer system that repeats development-transfer cycles, and the intermediate transfer method in which toner images of each color are primarily transferred sequentially onto an intermediate transferring member and then they are transferred at a time onto a transfer material.

Among them, the intermediate transfer method particularly has advantages in that it does not cause mixing of colors, and that it allows for the use of various transfer materials with different qualities and thicknesses.

As an example of the image forming apparatus utilizing the intermediate transfer method which is the background art of the present invention, FIG. 5 shows schematically a four-color, full-color laser beam printer that uses an intermediate transferring belt 9 in the form of a belt as the intermediate transferring member.

As shown in FIG. 5, over the peripheral surface of a photosensitive drum 1 as an image bearing member, a charger 2, an exposing apparatus 3 that irradiates the photosensitive drum 1 with laser light, rotary 22, as a rotating unit, that is rotatably and movably provided with four developing apparatuses 5, 6, 7 and 8 each containing a developer of different color, the intermediate transferring belt 9, and a photosensitive drum cleaner 19 as means for cleaning the image bearing member are sequentially arranged along the rotational direction (in the arrow R1 direction) of the drum.

As shown in FIG. 5, the photosensitive drum 1 having a diameter of 46.7 mm, which is rotationally driven at a surface velocity of 117 mm/sec in a direction indicated by an arrow R1, is negatively charged by the charger 2 on its surface. The photosensitive drum 1 charged by the charger 2 typically has a surface potential (hereinafter referred to as a "charge potential") from −450 V to −800 V. The charger 2 is applied with a charging bias that is an alternating voltage having a DC voltage superimposed on it with a charger power supply 17.

An electrostatic latent image is formed on the surface of the charged photosensitive drum 1 by an exposing light L from the exposing means 3 depending on the image information.

The exposing means 3 here has a light source 3*a* such as a laser, a six-sided polygon mirror 3*b* for raster scanning, a lens 3*c* for imaging, and a fold mirror 3*d*, etc.

If the developing apparatus 5 for a first, black color among the four developing apparatuses mounted on the rotary 22 is here opposed to the photosensitive drum 1, negatively charged black toner particles will be deposited onto the electrostatic latent image formed on the photosensitive drum 1 by the developing apparatus 5 for a first, black color, and developed as a developer image (toner image).

The intermediate transferring belt 9 is supported by multiple support axes consisting of a secondary transferring opposing roller 12, a drive roller 15, and a tension roller 16.

In the image forming apparatus shown in FIG. 5, as an example, the intermediate transfer belt 9 may be an endless plastic belt having a thickness on the order of 0.05 mm to 0.3 mm, and having a volume resistivity on the order of $10^7$ to $10^{11}\Omega\cdot$cm with its resistance adjusted by carbon, ZnO, $SnO_2$, $TiO_2$ and other conductive fillers. In this case, materials of the plastic belt may, for example, include PVdF (Poly(vinylidene fluoride)), Nylon, PET (polyethylene terephthalate), polycarbonate and the like.

By the rotation of the drive roller 15 (shown in a direction indicated by an arrow R2 in FIG. 5), the intermediate transferring belt 9 rotationally runs, as shown in FIG. 5, in an opposing position to the photosensitive drum 1 and in a direction indicated by an arrow R3 in FIG. 5 that is oriented in the same direction as the drum. When a primary transferring roller 10 having a diameter of 12 mm, which is located to be opposed to the photosensitive drum 1 across the intermediate transferring belt 9 and rotated following the intermediate transferring belt 9, is applied with a positively charged, primary transferring bias by a primary transferring power supply 20, the toner image on the photosensitive drum 1 is primarily transferred through a primary transferring nip N1 provided as a primary transferring position.

Here, as an example, +500 V DC voltage is used for the primary transferring bias. The primary transferring roller 10 typically consists of a material such as EPDM, urethane rubber, CR or NBR of which the volume resistivity is adjusted by adding a resistance controlling agent, such as carbon.

After the primary transfer, residual toner in the primary transfer is removed from the surface of the photosensitive drum 1 by the photosensitive drum cleaner 19 with a resilient blade.

A sequence of the afore-mentioned image forming processes of charge, exposure, development, primary transfer, and cleaning are sequentially repeated for each color toner of a second, magenta, a third, cyan, and a forth, yellow contained in developing apparatuses 6, 7 and 8 respectively, moved to an opposing position to the photosensitive drum 1, in order to layer toner images in four colors onto the intermediate transferring belt 9.

In an apparatus shown here, a primary transferring bias of +500 V is used for each color from the first to the fourth.

When a secondary transferring roller 11 having an outer diameter of 20 mm, which is located to be opposed to a secondary transferring opposing roller 12 rotating in a direction indicated by an arrow R4 in FIG. 5 that is oriented following the rotation of the intermediate transferring belt 9 across the intermediate transferring belt 9, is applied with a secondary transferring bias by a secondary transferring power supply 21, the four-color layered toner image on the intermediate transferring belt 9 is secondarily transferred at a time onto a surface of a transfer material P at a secondary transferring nip N2 of the secondary transferring opposing roller 12 and the secondary transferring roller 11, provided as a secondary transferring position. The intermediate transferring belt 9 is therefore a movable belt for transferring a toner image on the photosensitive drum 1 onto a transfer material. As an example, +1.5 KV is used for the secondary transferring bias.

The transfer material P bearing a four-color, unfixed toner image on its surface is conveyed to a fixing apparatus, not shown, in which the toner image on the surface is fixed to complete an image forming process.

After the secondary transfer as described above, the secondary transfer residual toner that consists of residual developer left untransferred on the intermediate transferring belt 9 is positively charged by a residual toner charging roller 123 that is applied with a positive DC voltage with a residual toner charging power supply 113 as means for charging residual developer, as described in Japanese Patent Application Laid-Open No. 9-44007.

The residual toner charging roller 123 has a mechanism, not shown, that is in spaced and abutted in relation to the intermediate transferring belt 9, and abuts against the belt only when it is charged. A reverse side of an abutting area N13 where the residual toner charging roller 123 and intermediate transferring belt 9 abut against each other is provided with a grounding opposing electrode 124 for increasing charging efficiency.

Finally, the positively charged toner is electrostatically transferred to the photosensitive drum 1 at the primary transferring nip N1, and the secondary transfer residual toner left on the intermediate transferring belt 9 is removed. Also, residual toner transferred to the photosensitive drum 1 is then removed by the photosensitive drum cleaner 19.

As another example of the means for removing the secondary transfer residual toner, the residual toner charging roller 123 may be applied with a bias voltage that is an alternating voltage superimposed by a positive DC voltage, as described in Japanese Patent Application Laid-Open No. 11-161043.

When means in which the secondary transfer residual toner is charged and electrostatically transferred to the photosensitive drum 1 is used as means for removing the secondary transfer residual toner, an adequate level of cleaning cannot be provided without a generally uniform amount of each charge of toner particles in the charged secondary transfer residual toner.

Toner particles with a lower amount of charge on the intermediate transferring belt 9 may be subject to a weaker electrostatic force from an electric field formed at a primary transferring nip N1, thereby failing to be transferred to the photosensitive drum 1. Toner particles with a higher amount of charge may, on the other hand, be subject to a greater mirroring force from the intermediate transferring belt 9, thereby failing to be transferred to the photosensitive drum 1.

An amount of charge retained by each particle of the secondary transfer residual toner can be almost leveled by a DC voltage. When an apparatus is used in an environment of a high temperature and humidity, however, the secondary transfer residual toner is poorly charged, and an amount of charge retained by each toner particle of the secondary transfer residual toner cannot be leveled by a DC voltage.

Using a bias that is an alternating voltage having a DC voltage superimposed on it, which has an advantage over a DC voltage in terms of an electrostatic force, therefore, enables to almost level an amount of charge retained by each toner particle of the secondary transfer residual toner even when a large amount of the secondary transfer residual toner presents in an environment of a high temperature and humidity, thereby allowing to provide an adequate level of cleaning.

While a level of cleaning of the intermediate transferring belt increases, the toner scattering has been observed near the abutting area N13 of the residual toner charging roller 123 against the intermediate transferring belt 9, resulting in a contamination inside of a machine after actual printing using an image forming apparatus in which a bias voltage that is an alternating voltage having a DC voltage superimposed on it is applied to the residual toner charging roller 123 as means for charging residual toner.

SUMMARY OF THE INVENTION

It is an object of the present invention to provide an image forming apparatus that adequately cleans up residual toner on an intermediate transferring member while at the same time it avoids contamination inside of a machine by the toner scattering.

It is another object of the present invention to provide an image forming apparatus comprising: an image bearing member for bearing a toner image; a movable intermediate transferring member; a first charging member for charging toner on the intermediate transferring member when it is applied with a voltage including an AC component; a second charging member for charging toner on the intermediate transferring member when it is applied with a DC voltage, the second charging member being located on an upstream side of the first charging member with respect to a moving direction of the intermediate transferring member, wherein the toner image on the image bearing member is temporarily transferred to the intermediate transferring member and then transferred to a transfer material.

It is still another object of the present invention to provide an image forming apparatus comprising: an image bearing member for bearing a toner image; a movable belt for transferring a toner image on the image bearing member to a transfer material; a first charging member for charging toner on the belt when it is applied with a voltage including an AC component; a second charging member for charging toner on the belt when it is applied with a DC voltage, the second charging member being located on an upstream side of the first charging member with respect to a moving direction of the belt.

Further objects of the present invention will be apparent from the following description.

DESCRIPTION OF THE PREFERRED EMBODIMENTS

An image forming apparatus according to the present invention will now be described in greater detail with reference to the drawings.

<Embodiment 1>

Figure 1:
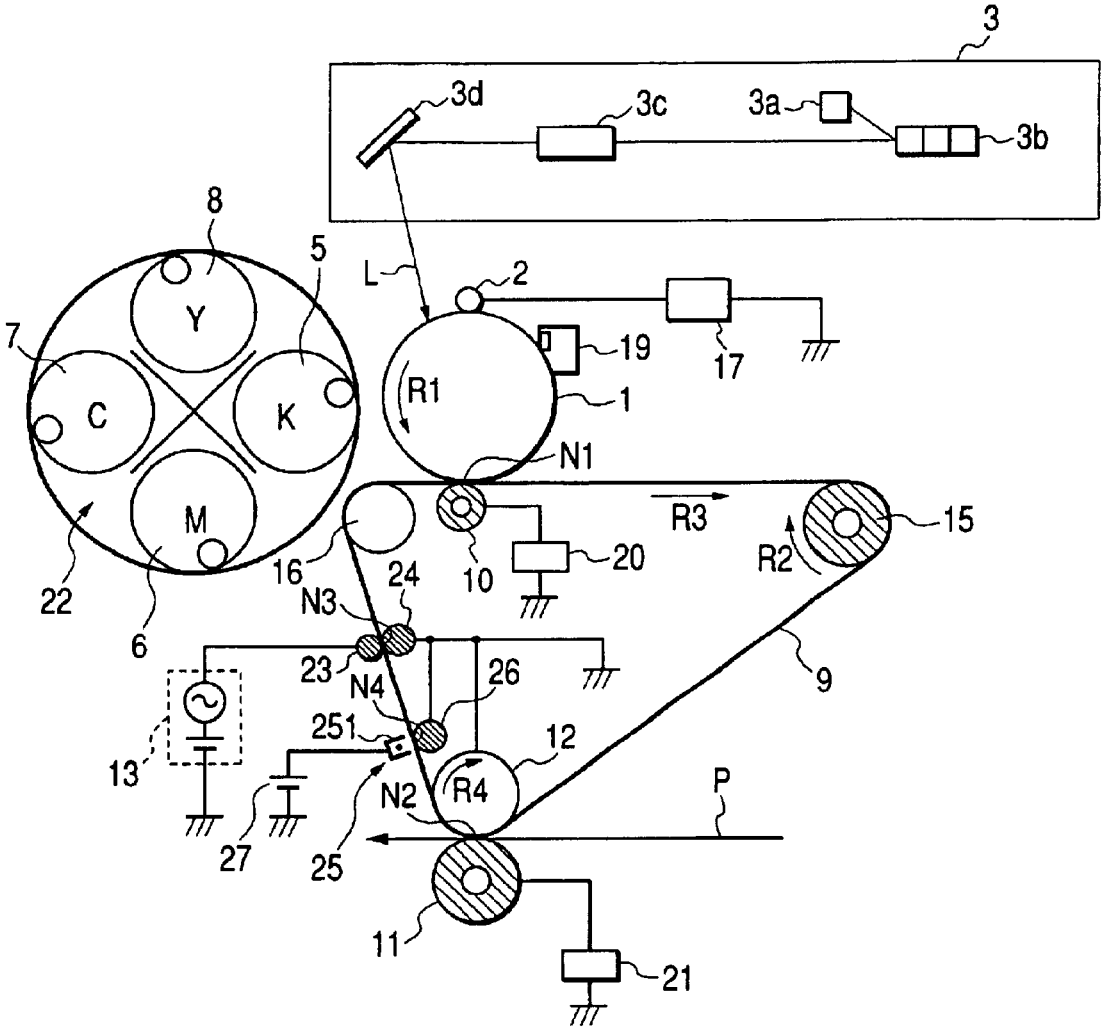
FIG. 1 is a schematic diagram showing an example of an image forming apparatus according to the present invention.
Figure 5:
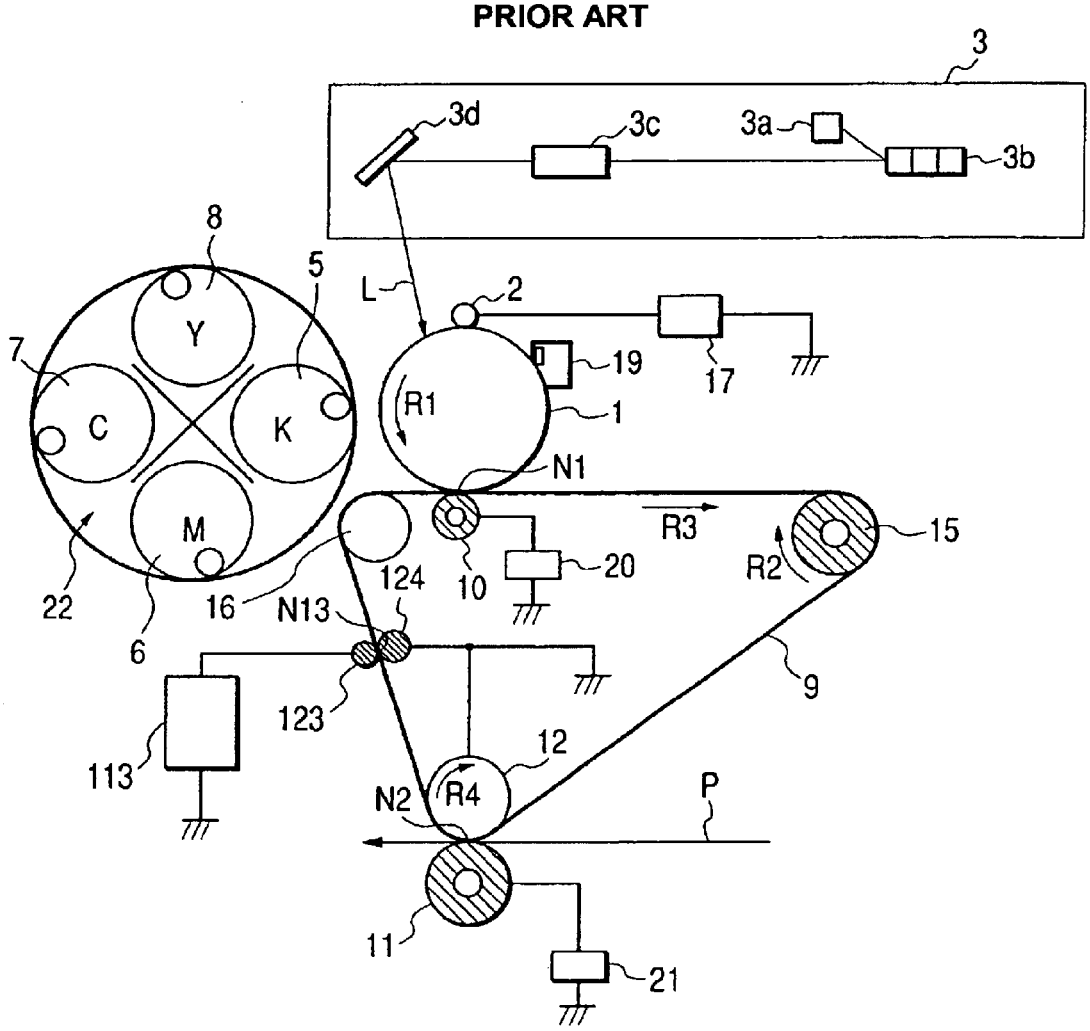
FIG. 5 PRIOR ART
FIG. 5 is a schematic diagram showing an example of an image forming apparatus of the background art of the present invention.

FIG. 1 shows a schematic diagram of an image forming apparatus according to a first embodiment of the present invention, wherein the apparatus is provided with an auxiliary residual toner charging member 25 constituting second means for charging residual developer when a residual toner charging roller 23 is intended to constitute first means for charging residual developer. Although the present invention is described with reference to FIG. 1, members operating in the same way as those shown in FIG. 5 are designated by the same reference characters and are not described further herein, because the arrangement is the same as that of an image forming apparatus shown in FIG. 5 other than members related to means for charging the secondary transfer residual toner.

A roller-shaped member composed of a rubber member having a volume resistivity of $10^9\Omega\cdot$cm at a thickness of 6 mm around a peripheral surface of a core metal having an outer diameter of 6 mm was used for a residual toner charging roller 23, which is a first charging member.

The residual toner charging roller 23 has a mechanism, not shown, that is in spaced and abutted relation to the intermediate transferring belt 9, and abuts against the belt only when it is charged. A reverse side of an abutting area N3 where the residual toner charging roller 23 and intermediate transferring belt 9 abut against each other is provided with a grounding opposing electrode 24 for increasing charging efficiency.

In charging the secondary transfer residual toner, the charging roller 23 is applied by a secondary transfer residual toner charging power supply 13 with a bias voltage that is a voltage including an AC component, i.e. an alternating voltage consisting of a sine wave having a frequency of 2 KHz and an amplitude of 2 KV, superimposed by +1 KV DC voltage.

The present invention is characterized in that an auxiliary residual toner charging member 25 is provided as second means for charging residual developer along the intermediate transferring belt 9 between a secondary transferring nip N2, which is in a secondary transferring position, and residual toner charging roller 23 provided as first means for charging residual developer, i.e. it is located prior to (on the upstream side of) the residual toner charging roller 23 provided as the first means for charging residual developer in a rotational direction (moving direction) of the intermediate transferring belt 9. The auxiliary residual toner charging member 25 is, therefore, provided on a downstream side of the secondary transferring nip N2 with respect to a moving direction of the intermediate transferring belt 9.

In this embodiment, a corona charger 251 is provided as an auxiliary residual toner charging member 25 which is a second charging member. A shield of the corona charger 251 is grounded and its wire is applied with a predetermined DC voltage by an auxiliary residual toner charging power supply 27.

A grounding opposing electrode 26 is provided to increase charging efficiency on a reverse side of the intermediate transferring belt 9 and in an opposing position N4 to the auxiliary residual toner charging member 25.

The secondary transfer residual toner remaining on the intermediate transferring belt 9 after the secondary transfer is supplied with positive charges by the corona charger 251 in which +5 KV DC voltage is applied to the shield. The polarity of toner particles of the secondary transfer residual toner is positive after passing through the corona charger 251, while an amount of charge of each of the toner particles is not uniform.

The secondary transfer residual toner is then charged by a first residual toner charging roller 23 applied with a bias voltage that is an alternating voltage superimposed by a positive DC voltage, and an amount of charge of each of the toner particles is almost leveled while maintaining the positive polarity of toner particles.

The positively charged secondary transfer residual toner then reaches a primary transferring nip N1.

The secondary transfer residual toner is electrostatically transferred to a photosensitive drum 1 at the primary transferring nip N1 and removed from the intermediate transferring belt 9. At this time, the surface of the photosensitive drum 1 is uniformly charged with −550 V. A primary transferring roller 10 is applied with +500 V DC voltage by a primary transferring power supply 20.

The secondary transfer residual toner transferred to the photosensitive drum 1 is collected into a photosensitive drum cleaner 19, thereby completing the removal of the secondary transfer residual toner on the intermediate transferring belt 9.

In this embodiment, even when the residual toner charging roller 23 is applied with a bias voltage that is an alternating voltage having a DC voltage superimposed on it, a contamination within a machine by the toner scattering near the abutting area N3 of the residual toner charging roller 23 against the intermediate transferring belt 9 has successfully been avoided with the effect of the auxiliary residual toner charging member 25.

Causes of the toner scattering occurring near the abutting area N3 of the residual toner charging roller 23, which constitutes first means for charging residual developer applied with a bias voltage that is an alternating voltage having a DC voltage superimposed on it, against the intermediate transferring belt 9, and the effect of the auxiliary residual toner charging member 25 constituting second means for charging residual developer are now described below.

The secondary transfer residual toner is subject to an electrostatic force from electric field formed by a bias applied to the residual toner charging roller 23 near the abutting area N3 of the residual toner charging roller 23, and repeatedly flies off between the residual toner charging roller 23 and the intermediate transferring belt 9. During this process, the polarity of each particle of the secondary transfer residual toner turns positive and an amount of charge of each particle is made almost uniform.

Toner particles of the secondary transfer residual toner, particularly those having a lower amount of charge, however, may neither reach the residual toner charging roller 23 from the intermediate transferring belt 9 nor return to the intermediate transferring belt 9 while they are repeatedly flying. The toner particles with a lower amount of charge, therefore, become airborne and fall by either gravity or airflow caused by the rotation of the intermediate transferring belt 9, resulting in the toner scattering.

As described in Related Background Art section, in order to provide an adequate level of cleaning, an amount of charge retained by each toner particle of the secondary transfer residual toner is required to be leveled by charging the secondary transfer residual toner with the residual toner charging roller 23 applied with a bias voltage that is an alternating voltage having a DC voltage superimposed on it.

Any toner with a lower amount of charge within the secondary transfer residual toner, however, is scattered as described above.

As shown in this embodiment, an auxiliary residual toner charging member 25, which is applied with a DC voltage so that it constitutes second means for charging residual developer, can be used to positively charge the secondary transfer residual toner before charging it with a residual toner charging roller 23 that constitutes the first means for charging residual developer. This allows toner with a lower amount of charges within the secondary transfer residual toner, which is scattered near the abutting area N3 of the residual toner charging roller 23, to be supplied with a sufficient amount of charge to prevent toner from scattering, thereby enabled to avoid the toner scattering.

In this way, the toner scattering has been prevented from occurring, and an adequate level of cleaning has been provided.

<Embodiment 2>

Figure 2:
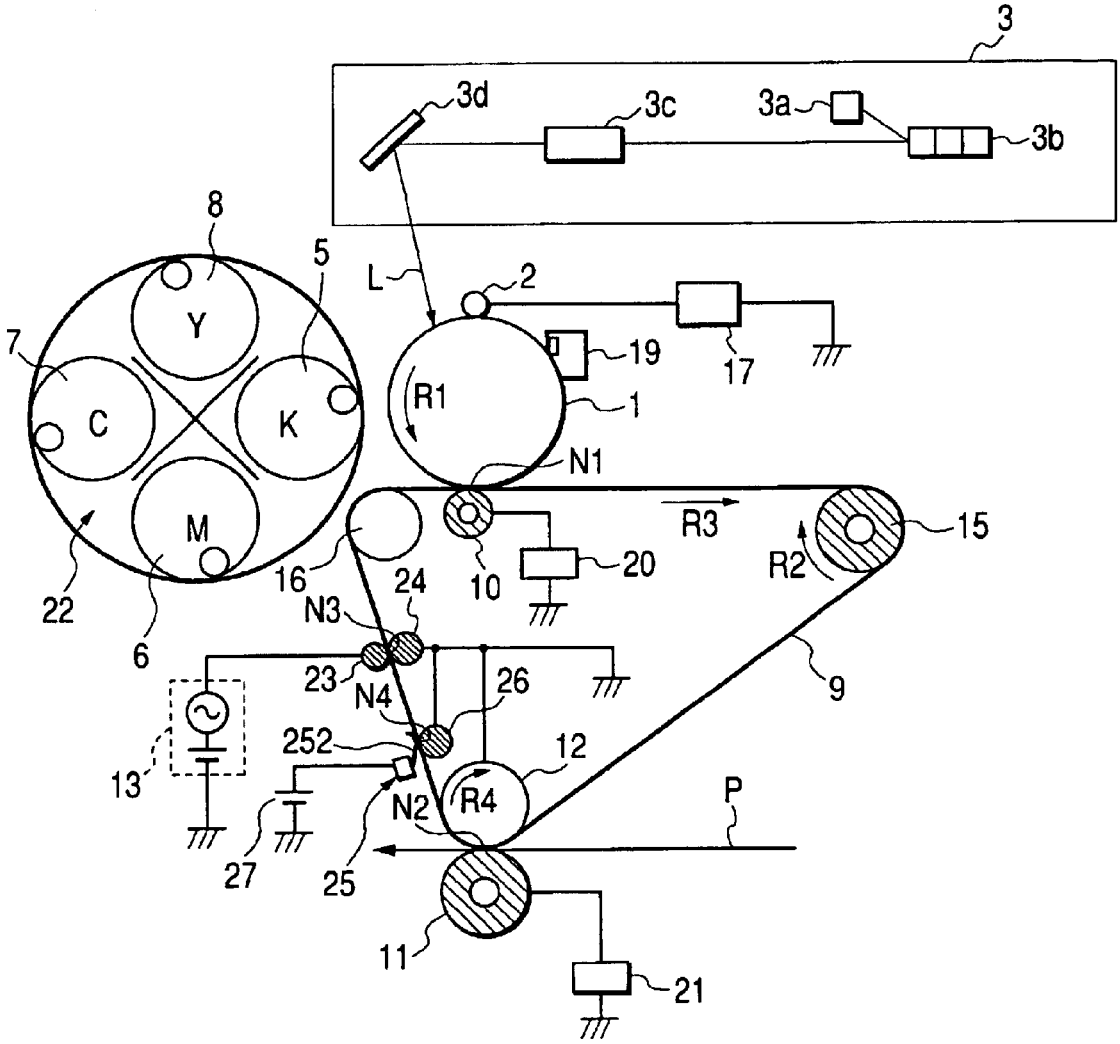
FIG. 2 is a schematic diagram showing another example of an image forming apparatus according to the present invention.

FIG. 2 is a schematic diagram showing Embodiment 2 of an image forming apparatus of the present invention, which is provided with an auxiliary residual toner charging member 25 constituting the second means for charging residual developer when a residual toner charging roller 23 is intended to constitute the first means for charging residual developer. Although the present invention is described with reference to FIG. 2, members operating in the same way as those shown in FIG. 5 and Embodiment 1 are designated by the same reference characters and are not described further herein, because the arrangement of this embodiment is also the same as that of an image forming apparatus shown in FIG. 5 other than members related to means for charging the secondary transfer residual toner.

In this embodiment, a conductive sheet 252 which is sheet-shaped member was used as an auxiliary residual toner charging member 25.

The conductive sheet 252 has a mechanism, not shown, that is in spaced and abutted relation to the intermediate transferring belt 9, and abuts against the belt only when it is charged. A reverse side of an abutting area N4 where the conductive sheet 252 and intermediate transferring belt 9 abut against each other is provided with a grounding opposing electrode 26 for increasing charging efficiency.

Even when the conductive sheet 252 is used as an auxiliary residual toner charging member 25 as shown in this embodiment, the secondary transfer residual toner can be supplied with a sufficient amount of positive charge in advance, the toner scattering occurring near the nip N3 of the residual toner charging roller 23, which constitutes first means for charging residual developer, against the intermediate transferring belt 9 has successfully been reduced, as in the case of Embodiment 1.

In addition, using the conductive sheet 252 abutting against the intermediate transferring belt 9 as the auxiliary residual toner charging member 25 makes necessary voltage lower than the corona charger 251 used in Embodiment 1. This, therefore, provides for the reduction of power consumption as well as ozone generation.

As in the case of Embodiment 1, a roller-shaped molded member composed of a rubber member having a thickness of 6 mm and a volume resistivity of $10^9\Omega\cdot$cm around a core metal having an outer diameter of 6 mm was used for a residual toner charging roller 23. In charging the secondary transfer residual toner, the roller is applied with a bias voltage that is a voltage including an AC component, i.e. an alternating voltage consisting of a sine wave having a frequency of 2 KHz and an amplitude of 2 KV, superimposed by +1 KV DC voltage.

A member formed at a thickness of 100 $\mu$m from a material consisting of a PVdF (Poly(vinylidene fluoride)) resin dispersed with carbon black and having a volume resistivity adjusted to about $10^8\Omega\cdot$cm was used as the conductive sheet 252. In charging the secondary transfer residual toner, the sheet is applied with +2 KV DC voltage from auxiliary residual toner charging power supply 27, as an auxiliary power supply for charging residual toner.

The secondary transfer residual toner remaining on the intermediate transferring belt 9 after the secondary transfer is supplied with positive charges by the conductive sheet 252 that is applied with a DC voltage. The polarity of toner particles of the secondary transfer residual toner is positive after passing through the conductive sheet 252, while an amount of charge of each toner particle is not uniform. The secondary transfer residual toner is then charged by a residual toner charging roller 23 applied with a bias voltage by the power supply 13, which is an alternating voltage superimposed by a positive DC voltage, and an amount of charge of each toner particle is made almost uniform while maintaining the positive polarity of toner particles.

The toner scattering is, therefore, avoided near the abutting area N3 of the residual toner charging roller 23. The positively charged secondary transfer residual toner then reaches a primary transferring nip N1.

The secondary transfer residual toner is electrostatically transferred to a photosensitive drum 1 at the primary transferring nip N1 and removed from the intermediate transferring belt 9. At this time, a surface of the photosensitive drum 1 is uniformly charged with −550 V. A primary transferring roller 10 is applied with +500 V DC voltage.

The secondary transfer residual toner transferred to the photosensitive drum 1 is collected into a photosensitive drum cleaner 19, thereby completing the removal of the secondary transfer residual toner on the intermediate transferring belt 9.

<Embodiment 3>

Figure 3:
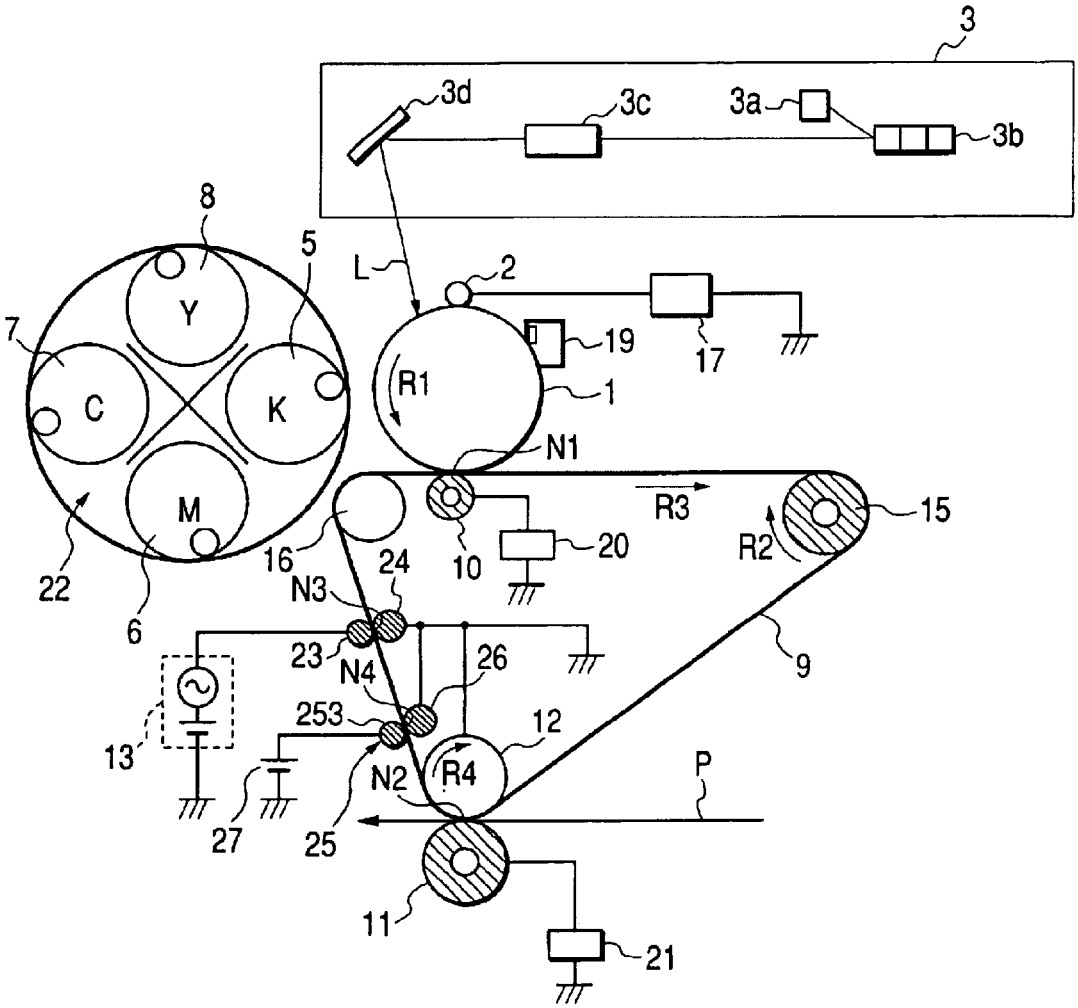
FIG. 3 is a schematic diagram showing still another example of an image forming apparatus according to the present invention.

FIG. 3 is a schematic diagram showing Embodiment 3 of an image forming apparatus of the present invention, which is provided with an auxiliary residual toner charging member 25 as the second means for charging residual developer, when a residual toner charging roller 23 is intended to constitute the first means for charging residual developer. Although the present invention is described with reference to FIG. 3, members operating in the same way as those shown in FIG. 5 and Embodiment 1 are designated by the same symbols, and are not described further herein, because the arrangement in this embodiment is also the same as that of an image forming apparatus shown in FIG. 5 other than members related to means for charging the secondary transfer residual toner, as in the case of Embodiments 1 and 2.

In this embodiment, a conductive resilient roller 253 having a 10-point means surface roughness Rz of 8.0 $\mu$m or less is used as an auxiliary residual toner charging member 25, which is applied with a positive DC voltage by a power supply 27, and abuts against the intermediate transferring belt 9 in charging the secondary transfer residual toner.

The conductive resilient roller 253 has a mechanism, not shown, that is in spaced and abutted relation to the intermediate transferring belt 9, and abuts against the belt only when it is charged. A reverse side of an abutting area N4 where the conductive resilient roller 253 and intermediate transferring belt 9 abut against each other is provided with a grounding opposing electrode 26 for increasing charging efficiency.

Even when the conductive resilient roller 253 is used as an auxiliary residual toner charging member 25 as shown in this embodiment, the secondary transfer residual toner can be supplied with a sufficient amount of positive charge in advance, the toner scattering occurring near the abutting area N3 of the residual toner charging roller 23 as the conductive resilient roller has successfully been reduced.

In addition, using the conductive resilient roller 253 abutting against the intermediate transferring belt 9 as the auxiliary residual toner charging member 25 in charging the secondary transfer residual toner is made a necessary voltage lower than the corona charger 251 used in Embodiment 1, thereby providing for the reduction of power consumption as well as ozone generation. The deposition of the secondary transfer residual toner onto a surface of the conductive resilient roller 253 has also been reduced, resulting in stable charging performance.

As in the case of Embodiment 1, a roller-shaped molded member composed of a rubber member having a volume resistivity of $10^9\Omega\cdot$cm and a thickness of 6 mm around a core metal having an outer diameter of 6 mm is used as a residual toner charging roller 23. In charging the secondary transfer residual toner, the roller is applied from the residual toner charging power supply 13 with a bias voltage that is a voltage including an AC component, i.e. an alternating voltage consisting of a sine wave having a frequency of 2 KHz and an amplitude of 2 KV, superimposed by +1 KV DC voltage.

A roller-shaped member consisting of an NBR rubber dispersed with carbon black, having a volume resistivity adjusted to about $10^8\Omega\cdot$cm and a thickness of 6 mm, provided around a core metal having an outer diameter of 6 mm is used as the conductive resilient roller 253. In addition, the surface of the roller is polished and processed so that a 10-point means surface roughness Rz on the order of 0.2 $\mu$m can be obtained. In charging the secondary transfer residual toner, the roller is applied with +2.5 KV DC voltage from an auxiliary residual toner charging power supply 27.

The secondary transfer residual toner remaining on the intermediate transferring belt 9 after the secondary transfer is supplied with positive charges by the conductive resilient roller 253 that is applied with a DC voltage. The polarity of toner particles of the secondary transfer residual toner is positive after passing through the conductive resilient roller 253, while an amount of charge of each toner particle is not uniform. The secondary transfer residual toner is then charged by a residual toner charging roller 23 applied with a bias voltage that is an alternating voltage superimposed by a positive DC voltage, whereby an amount of charge of each toner particle is made almost uniform while maintaining the positive polarity of toner particles. The toner scattering is, therefore, avoided near the abutting area N3 of the residual toner charging roller 23.

The positively charged secondary transfer residual toner then reaches a primary transferring nip N1.

The secondary transfer residual toner is electrostatically transferred to a photosensitive drum 1 at the primary transferring nip N1 and removed from the intermediate transferring belt 9. At this time, a surface of the photosensitive drum 1 is uniformly charged with −550 V. A primary transferring roller 10 is applied with +500 V DC voltage.

The secondary transfer residual toner transferred to the photosensitive drum 1 is collected into a photosensitive drum cleaner 19, thereby completing the removal of the secondary transfer residual toner on the intermediate transferring belt 9.

Although a 10-point means surface roughness Rz of about 0.2 $\mu$m is used for the surface roughness of the conductive resilient roller 253 in this embodiment, the value Rz that is 0.01 $\mu$m or more but 8.0 $\mu$m or less also provides stable charging performance.

According to an investigation by the inventors, if the value Rz is smaller than 0.01 $\mu$m, the conductive resilient roller 253 does not smoothly rotate because there is a low friction between the conductive resilient roller 253 and the intermediate transferring belt 9 such that the secondary transfer residual toner is scraped off from the intermediate transferring belt 9, resulting in a contamination within a machine. If Rz is greater than 8.0 $\mu$m, the secondary transfer residual toner has been deposited on surface textures of the conductive resilient roller 253, resulting in the degraded charging performance.

In this embodiment, the following conditions were used for measuring a surface roughness Rz.

Instrument: Tokyo Seimitsu Co., Ltd., Surf-com-550A (trademark)

Measurement distance: 2 mm

Cut-off: 0.8 mm

Measurement speed: 3 mm/sec

From Embodiments 1 to 3, although a belt-shaped member has been described as an intermediate transferring member, the form of the intermediate transferring member is not limited to a belt, and any drum-shaped member may provide similar effects.

Figure 4:
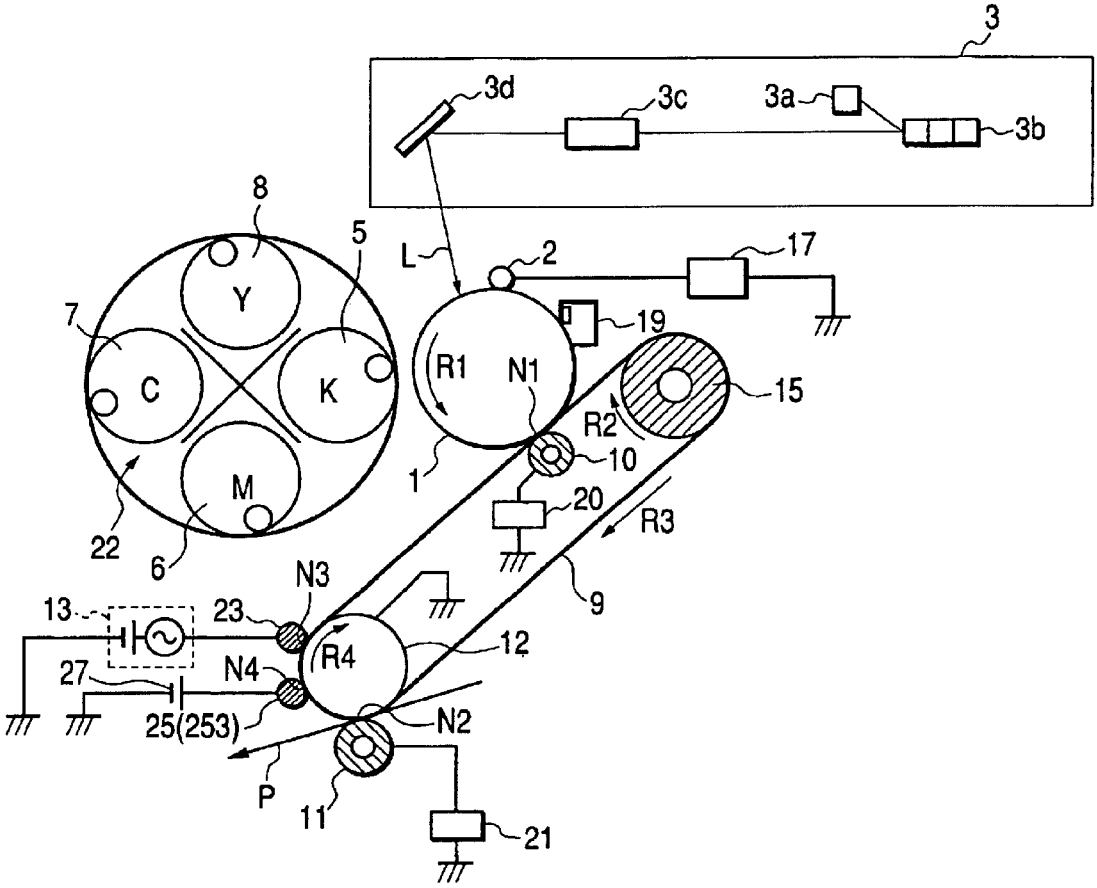
FIG. 4 is a schematic diagram showing further another example of an image forming apparatus according to the present invention.

In this specification, an opposing electrode is separately provided for each of the residual toner charging roller 23, auxiliary residual toner charging member 25 and secondary transferring roller 11. As shown in FIG. 4, however, using a secondary transferring opposing roller 12 as an opposing electrode for the residual toner charging roller 23 and the auxiliary residual toner charging member 25 (conductive resilient roller 253 in FIG. 4) may also provide similar effects.

Dimensions and arrangements of each member of an image forming apparatus described with reference to FIG. 1 to FIG. 5, and values of various types of separately applied bias etc. described above are not limited unless otherwise specified.

The present invention is applicable to other arrangements, and effective in an image forming apparatus in which each developing apparatus is arranged along an intermediate transferring member.

In this specification, the description has been made about the case where negatively charged toner is used as developer. When positively charged toner is used, however, it is apparent that all polarity and various types of separately applied bias described above are reversed to an opposite polarity.

In the embodiments described above, although the secondary transfer residual toner has been described as residual toner for illustrative purposes, the present invention is also applicable to the cleaning of a toner image for the density detection formed on a belt.

As described above, an image forming apparatus of the present invention includes: first means for charging residual developer that electrostatically charges residual developer remaining on an intermediate transferring member to a predetermined polarity by applying a voltage including an AC component, and second means for charging residual developer that applies a DC voltage along the intermediate transferring member between the secondary transferring position and the first means for charging residual developer, wherein residual developer is electrostatically transferred from the intermediate transferring member to an image bearing member at a primary transferring position, and wherein the residual developer is charged by the second means for charging residual developer applied with a DC voltage before charging it with the first means for charging residual developer, thereby providing the effects of avoiding a contamination within a machine due to the toner scattering even when a large amount of residual toner presents, and providing an adequate level of cleaning for residual toner on an intermediate transferring member.

Although some of embodiments of the present invention have been described, the present invention is in no way limited to the above embodiments, and any variations are possible within the scope of the present invention.

What is claimed is:

1. An image forming apparatus comprising:

an image bearing member for bearing a toner image;

a movable intermediate transferring member, wherein after a toner image on said image bearing member is temporarily transferred to said intermediate transferring member, the toner image is then transferred to a transfer material at a first transfer portion;

a first charging member for charging toner on said intermediate transferring member with an applied voltage, wherein an AC voltage is superimposed on a DC voltage; and a second charging member for charging toner on said intermediate transferring member with an applied DC voltage a polarity of which is the same as a polarity of the DC voltage that is applied to said first charging member, said second charging member being located on an upstream side of said first charging member and on a downstream side of said first transfer portion with respect to a moving direction of said intermediate transferring member, wherein the toner charged by said first charging member and said second charging member is transferred from said intermediate transferring member to said image bearing member at a transfer portion between said image bearing member and said intermediate transferring member.

2. The image forming apparatus according to claim 1, wherein said first charging member comprises a roller.

3. The image forming apparatus according to claim 1, wherein said second charging member comprises a corona charger.

4. The image forming apparatus according to claim 1, wherein said second charging member comprises a sheet member.

5. The image forming apparatus according to claim 1, wherein said second charging member comprises a conductive resilient roller.

6. The image forming apparatus according to claim 5, wherein a surface roughness Rz of said conductive resilient roller is 0.01 $\mu$m or more but 8.0 $\mu$m or less.

7. The image forming apparatus according to claim 1, wherein a polarity of the DC voltage that is applied to said first charging member and said second charging member is opposite to a regular polarity of the toner.

8. An image forming apparatus comprising:

an image bearing member for bearing a toner image;

a movable belt for transferring a toner image on said image bearing member to a transfer material at a first transfer portion;

a first charging member for charging toner on said belt with an applied voltage, wherein an AC voltage is superimposed on a DC voltage; and a second charging member for charging toner on said belt with an applied DC voltage a polarity of which is the same as a polarity of the DC voltage that is applied to said first charging member, said second charging member being located on an upstream side of said first charging member and on a downstream side of said first transfer portion with respect to a moving direction of said belt, wherein the toner charged by said first charging member and said second charging member is transferred from said belt to said image bearing member at a transfer portion between said image bearing member and said belt.

9. The image forming apparatus according to claim 8, wherein said first charging member comprises a roller.

10. The image forming apparatus according to claim 8, wherein said second charging member comprises a corona charger.

11. The image forming apparatus according to claim 8, wherein said second charging member comprises a sheet member.

12. The image forming apparatus according to claim 8, wherein said second charging member comprises a conductive resilient roller.

13. The image forming apparatus according to claim 12, wherein a surface roughness Rz of said conductive resilient roller is 0.01 $\mu$m or more but 8.0 $\mu$m or less.

14. The image forming apparatus according to claim 8, wherein a polarity of the DC voltage that is applied to said first charging member and said second charging member is opposite to a regular polarity of the toner.

* * * * *

UNITED STATES PATENT AND TRADEMARK OFFICE

CERTIFICATE OF CORRECTION

PATENT NO. : 6,856,777 B2
DATED : February 15, 2005
INVENTOR(S) : Naoki Enomoto et al.

It is certified that error appears in the above-identified patent and that said Letters Patent is hereby corrected as shown below:

Column 2,
Line 47, “afore-mentioned” should read -- aforementioned --; and
Line 51, “forth” should read -- fourth, --.

Column 6,
Line 24, “a” (first occurrence) should be deleted.

Column 7,
Line 6, “charges” should read -- charge --.

Column 12,
Line 21, “belt,” should read -- belt. --.

Signed and Sealed this

Nineteenth Day of July, 2005

JON W. DUDAS
*Director of the United States Patent and Trademark Office*